United States Patent [19]

Heutschi et al.

[11] 3,992,600

[45] Nov. 16, 1976

[54] ELECTRICAL SWITCH

[75] Inventors: Hans Heutschi, Kappel near Olten; Richard Thaler, Unterentfelden, both of Switzerland

[73] Assignee: Sprecher & Schuh, Aarau, Switzerland

[22] Filed: July 28, 1975

[21] Appl. No.: 599,946

[30] Foreign Application Priority Data

Sept. 28, 1974 Switzerland ..... 11700/74

[52] U.S. Cl. ..... 200/153 R

[51] Int. Cl.[2] ..... H01H 35/38

[58] Field of Search ..... 200/153 R, 153 E, 153 G, 200/153 H, 153 N, 153 V, 329, 331

[56] References Cited

UNITED STATES PATENTS 3,113,191 12/1963 Frank ..... 200/153 H

*Primary Examiner*—Herman J. Hohauser

*Attorney, Agent, or Firm*—Haseltine, Lake & Waters

[57] ABSTRACT

An electrical switch comprising a drive mechanism for moving a switch component at a pre-selected variable speed. A movable additional mass is connected at a drive branched-off the drive mechanism of the moved switch component, said branch drive possessing a transmission ratio which is variable as a function of the position of the moved switch component.

9 Claims, 4 Drawing Figures

Fig. 1
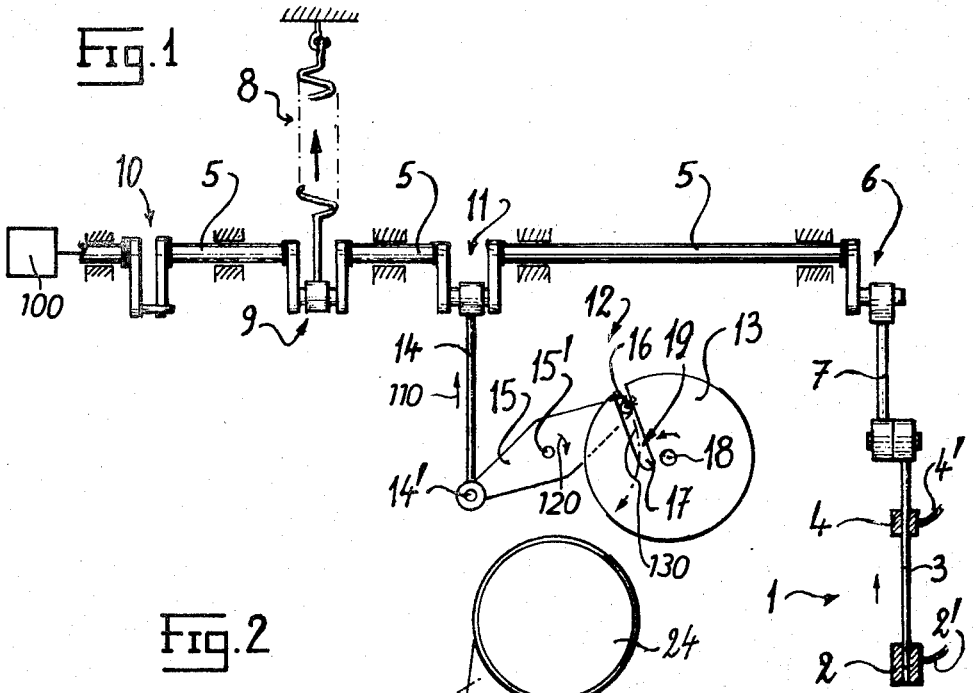
Fig. 2
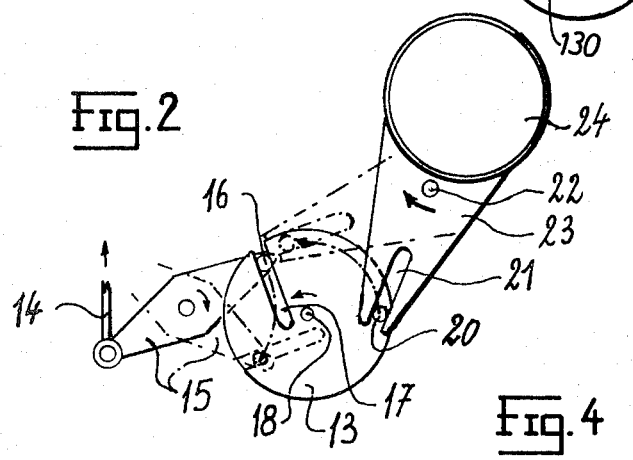
Fig. 4
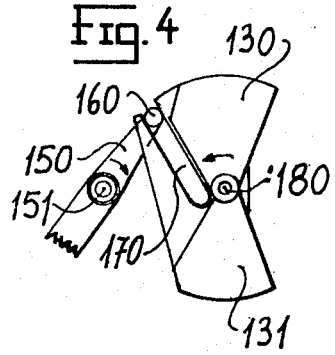
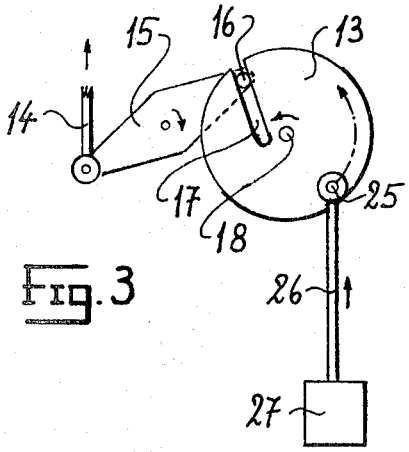
Fig. 3

ELECTRICAL SWITCH

BACKGROUND OF THE INVENTION

The present invention relates to a new and improved construction of an electrical or electric switch having a drive mechanism for moving a switch component at a speed which varies in a pre-selected manner.

For instance when separating the contacts of certain switches it can be necessary to displace the moved contact, i.e. the moved switch component at a variable speed in order to take into account the different requirements regarding the cut-off or separation operation e.g. the extinguishing of the arc and the gentle slowing down during as rapid as possible switching operation. In order to be able to cope with the foregoing there have already been used drives (for instance Maltese cross drives or elliptical gear drives) possessing a transmission ratio which varies depending upon the relative position of the drive and the moved switch component. In order to reduce the possibly arising surges, there have been provided balancing oscillating masses in the transmission chain of the drive between the power source and the moved switch component. However, increased drive power is necessary due to the friction and mass of such drives. On the other hand, there are in direct conflict with one another the demands regarding smooth transition and the high power requirements.

SUMMARY OF THE INVENTION

Hence, it is a primary object of the present invention to provide an improved construction of an electrical switch which is not associated with the aforementioned drawbacks and limitations of the prior art proposals.

Another and more specific object of the present invention aims at the provision of a new and improved construction of switch having a drive which, with relatively small drive power and as simple as possible construction, renders possible the realization of a predetermined course of the speed of the moved switch component.

Now in order to implement these and still further objects of the invention, which will become more readily apparent as the description proceeds, the invention contemplates the provision of a new and improved construction of an electrical switch of the previously mentioned type which is manifested by the features that a movable additional mass is connected to a drive branched-off from the positive drive mechanism of the moved switch component, this branched-off drive or branch drive possessing a transmission ratio which is variable as a function of the position of the moved switch component.

The fact that the additional mass is connected via the aforementioned branch drive possessing variable transmission ratio renders it possible for the inertia of the additional mass, depending upon the transmission ratio of the drive, to have a different effect at different points in time of the switching operation and different amounts of drive energy are tapped-off of the drive mechanism of the moved switch component and absorbed or again returned back to the system, so that there can be realized an almost random variation of the course of the speed of the moved switch component.

Now since it is possible to construct the moved switch component and its direct drive as simple and mass-free as possible, it is possible to maintain small the drive power. However, it is possible to select the additional mass to be relatively large, so that the same can develop a different degree of action depending upon the transmission ratio of the branched-off or branch drive. If the momentary transmission ratio of the branch drive is adjusted such that the additional mass does not or hardly moves, then the drive energy acts completely upon the moved switch component and markedly accelerates the same. However, if the transmission ratio is altered such that the additional mass must be moved more rapidly, then such is initially braked owing to the inertia of the entire drive whereupon it tends to again store energy as an oscillating mass, if after reaching equilibrium the drive power (e.g. in the case of a power or energy storage) again decreases. Also in this stage it is possible to influence the effect of the additional mass upon the moved switch component by changing the transmission ratio.

There can be connected at least one further movable additional mass after the additional mass by means of at least one further drive possessing a variable transmission ratio. This results in further influencing the course of movement and thus the course of the speed of the moved switch component without requiring complicated drives.

In accordance with a simple constructional embodiment of the invention there can be used as the branched-off or branch drive lever drives, for instance such where it is possible to change the lever arm ratio or leverage during the course of the rocking or pivoting of the lever in such a manner that the lever engages into a slot of a rotatable cam disk. The cam disk can be part of an additional mass.

As the power or energy source of the drive there can be used all known systems, such as springs, hydraulic devices, pneumatic devices, motors, and so forth, just to mention a few noteworthy possibilities.

BRIEF DESCRIPTION OF THE DRAWING

The invention will be better understood and objects other than those set forth above, will become apparent when consideration is given to the following detailed description thereof. Such description makes reference to the annexed drawing wherein:

FIG. 1 illustrates an electric switch having a drive mechanism and designed according to the present invention;

FIG. 2 illustrates a branch drive equipped with an additional mass according to a first embodiment;

FIG. 3 illustrates a branch drive having an additional mass according to a second embodiment; and FIG. 4 illustrates a branch drive having an additional mass according to a still further embodiment.

DETAILED DESCRIPTION OF THE PREFERRED EMBODIMENTS

Describing now the drawing, the electric or electrical switch 1 illustrated by way of example in FIG. 1 possesses a fixed contact 2 having an infeed conductor or line 2' and a movable component or part constructed as a contact or switching pin 3. This movable component or part 3 is connected, for instance, through the agency of means 4 constructed as a sliding- or roll contact with the infeed line or conductor 4'. The electrical switch 1 has been shown in its switched-on condition or state into which it can be brought by rotating a shaft 5 and thus by moving a crank 6 and a connecting rod 7. During such rotation of the shaft 5 there is also simultaneously biased or stressed a switch cut-off spring 8 or equivalent structure by means of a crank 9. The shaft 5 is thus in a position preparatory for cutting-off the switch 1. This shaft rotation can take place through the action of a suitable schematically indicated drive 100, which may be constituted, for instance, by a hoisting or lifting motor of random construction or by another spring storage or by other conventional means via the coupling 10.

Instead of the previously described components there can be of course also provided different constructed switch- and drive components of known construction. For instance, there could be provided other power or energy storages and/or other drives (such as hydraulic drives and the like). The switch could be, for instance, also a multi-position switch, multiple-contact switch and/or a rotary switch.

Initially there should be imagined the previously described apparatus illustrated in FIG. 1 without the crank 11 and the therewith connected components which will be still discussed hereinafter. If in this condition the shaft 5 is released, then, the spring 8 will rotate the shaft 5 and thus the crank 6 and by means of the connecting rod 7 the contact pin 3 will be displaced out of the fixed or stationary contact 2. The entire operation occurs in a sudden manner. Hence, there could not be taken into account, for instance, extinguishing of the arc during separation of the contacts 2 and 3. It is necessary for mechanical and electrical reasons to thus control the movement of the contact pin 3 in such a manner that its momentary speed corresponds to the prevailing requirements. This occurs in the arrangement of FIG. 1 by means of a branch or secondary drive 12 and an additional mass 13. The branch or secondary drive 12 comprises a crank 11, a connecting rod 14 engaging therewith and serving for reversal of the motion and which connecting rod 14 is connected by means of a hinge or pivot joint 14' with a double-arm lever 15. This double-arm lever 15 which is pivotably mounted at location 15' engages by means of a roller 16 with a control slot 17 of the additional mass 13 simultaneously serving as a cam disk. The additional or supplementary mass 13 is rotatable abouts its center of rotation 18.

Now if there is again considered the previously mentioned relaxation of the spring 8 while rotating the shaft 5, then it will be recognized that the crank 11 rotates along therewith and hence the connecting rod 14 is moved in the direction of the arrow 110, bringing about a rocking or pivoting of the lever 15 about its pivot means or bearing 15' in the direction indicated by the arrow 120. Consequently, the roller or roll member 16 can be initially displaced in the slot 17 without any appreciable movement of the additional mass 13, and which roller movement has been schematically indicated by the phantom-line or chain-dot arrow 130. This in effect means that the additional mass 13 is initially essentially not really moved at all, in other words, the entire force of the spring 8 is available for moving the switching pin or contact 3 which is thus markedly accelerated and immediately can be brought to a high speed of movement which is proper for the momentary separation of the contacts 2 and 3. The entire system is coordinated such that the contacts 2 and 3 can now move very rapidly away from one another to such an extent until the tip of the movable contact or pin 3 enters the extinguishing zone (not shown) where, as is well known in this particular art, there is required a certain residence or dwell time or a slow movement of the contact or switching pin 3 in order to rapidly extinguish the arc. With this position of the switching pin or contact 3 the roller 16 has moved forwardly in the slot 17 approximately to the position indicated by reference character 19, so that now the additional mass 13 must be markedly moved through the action of an unfavorable small lever arm at the region of the center of rotation 18 when the lever 15 should be further rapidly pivoted or rocked. The inertia of the mass 13 and the unfavorable transmission ratio now lead via the branch drive 12 to a mass-controlled braking of the shaft 5 and thus the contact or pin 3, so that it momentarily can almost come to standstill. Now, with extremely small acceleration, if the mass 13 is placed into movement and the roller 16 migrates past the center of rotation 18 of the mass 13, then there is not only stopped the braking action of the mass 13, rather the mass 13 which has been brought into movement now in fact augments the further movement of the entire system so that the pin 3 —the arc in the meantime has extinguished— initially is rapidly moved out of the extinguishing zone and then gently into the off-position.

The described operation can be almost randomly coordinated to the system by means of the shape or form of the slot 17. For reasons of simplicity in the showing of the drawing there has only been portrayed a straight or linear slot 17, but it could be of another desired configuration. The techniques known in the art for the construction of eccentric mechanisms can be advantageously employed during the determination of the appropriate shape or form of the slot 17.

A further influencing of the speed of movement of the switching pin or contact 3 can be realized in that after the first additional mass there is connected one or a number of further additional masses via at least one further branch drive of the aforementioned type. This has been illustrated with the arrangements of FIGS. 2 and 3.

There will be again recognized in the showing of FIGS. 2 and 3 the connecting rod 14, the double-arm lever 15, the roller or roll member 16, the additional mass 13 and its slot 17.

In FIG. 2 a roller member or roll 20 is located in a crankpin-like manner at the additional mass 13. The roller 20 engages in a slot 21 —which approximately functionally corresponds to the slot 17— of a lever 23 which is pivotably mounted upon a shaft 22, this lever 23 carrying a second additional mass 24. During the movement previously explained in conjunction with the arrangement of FIG. 1 the roller 20 can initially relatively easily accelerate the mass 24 via the long lever arm, this leverage or lever arm ratio changes unfavorably for the roller 20 and in favor of the mass 24 in the first half of the movement, so that there can be increased the delay desired in the extinguishing zone or region. Before and after there is only present a slight dampening.

In contrast to a non-radial course of the slot 17 which thus enables realizing also a different leverage with respect to the roller 16 during both halves of the movement, the radial position of the slot 21 with respect to the roller 20 provides for the same leverage during both movement halves.

In the arrangement of FIG. 3 an additional weight or mass 27 is suspended at a crankpin 25 by means of a connecting rod 26 and which weight generally exerts a dampening action. Since the lever arm of the weight 27 is initially reduced, its dampening action is greater at the start and end of the movement, so that it facilitates the gently start-up and slowing down.

In FIG. 4 there is pivotably mounted a double-arm lever 150 —similar to the lever 15 of the arrangements of FIGS. 1 to 3— about a pivot shaft 151 so that its roller 160 can similarly engage with a slot 170 of the mass 130 rotating about the center of rotation 180 as has already been described for the roller 16 of the lever 15 which engages in the slot 17 of the mass 13. The mass 130 is balanced-out by means of a compensation or balancing mass or weight 131, which allows arranging this system with its shaft independently of the force of gravitation. It is free of imbalance. In order to prevent any misconceptions, it is here mentioned that in the case of the arrangements of FIGS. 1 to 3 imbalance will arise. With horizontal arrangement of the axis of rotation of the mass 13 of the systems according to FIGS. 1 to 3 the irregularities of the masses also can be additionally effective with respect to the force of gravitation, whereas this effect is avoided with the systems of FIGS. 1 and 2 with vertical arrangement of the aforementioned axis. In the case of the arrangement of FIG. 3 the action of the gravitational force upon the weight or mass 27 is desired.

While there is shown and described present preferred embodiments of the invention, it is to be distinctly understood that the invention is not limited thereto, but may be otherwise variously embodied and practiced within the scope of the following claims. Accordingly,

What is claimed is:

1. An electrical switch including a switch component, a drive mechanism for positively moving the switch component at a speed which can be varied in a preselected manner, branch drive means branched-off from said drive mechanism of the moved switched component, a movable additional mass connected with said branch drive means, said branch drive means possessing a transmission ratio which is variable as a function of the position of the moved switch component.

2. The electrical switch as defined in claim 1, wherein at least one further additional mass is connected via a further branch drive means possessing a variable transmission ratio following said additional mass.

3. The electrical switch as defined in claim 1, wherein the additional mass is connected with a counterweight.

4. The electrical switch as defined in claim 1, wherein the additional mass is connected with a compensation weight.

5. The electrical switch as defined in claim 2, further including a counterweight with which there is connected at least one of the additional masses.

6. The electrical switch as defined in claim 2, further including a compensation weight with which there is connected at least one of the additional masses.

7. The electrical switch is defined in claim 2, wherein at least one of the branch drive means of one of the additional masses comprises a lever drive structure incorporating an element engaging in a slot of a cam disk.

8. The electrical switch as defined in claim 7, further including means mounting the cam disk to be rotatable about a center of rotation, and said slot is arranged essentially radially with respect to the center of rotation of the cam disk.

9. The electrical switch as defined in claim 7, further including means mounting the cam disk to be rotatable about a center of rotation, said slot at least extending in stages in a direction which extends past the center of the rotation of the cam disk.

* * * * *

UNITED STATES PATENT AND TRADEMARK OFFICE

CERTIFICATE OF CORRECTION

PATENT NO. : 3,992,600
DATED : November 16, 1976
INVENTOR(S) : Heutschi et al

It is certified that error appears in the above–identified patent and that said Letters Patent are hereby corrected as shown below:

Change name of assignee to

SPRECHER & SCHUH AG

Change priority date of Swiss Patent Application No. 11700/74 to --August 28, 1974--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*